US005938107A

United States Patent [19]

Anchor et al.

[11] Patent Number: 5,938,107

[45] **Date of Patent: *Aug. 17, 1999**

[54] PACKAGING CONTAINER AND A BLANK FOR PRODUCING THE SAME

[75] Inventors: David Anchor, Itasca, Ill.; Tommy Bo Göran Ljungström, Hoor, Sweden; Mauro Morandi, Modena, Italy

[73] Assignee: Tetra Laval Holdings & Finance S.A., Pully, Switzerland

[ * ] Notice: This patent is subject to a terminal disclaimer.

[21] Appl. No.: 08/739,723

[22] Filed: Oct. 29, 1996

Related U.S. Application Data

[63] Continuation-in-part of application No. 08/620,698, Mar. 21, 1996, Pat. No. 5,738,272.

[30] Foreign Application Priority Data

Jul. 10, 1996 [IT] Italy ..... MI96A1424

[51] Int. Cl.[6] ..... B65D 5/02

[52] U.S. Cl. ..... 229/109; 229/116.1; 229/137; 229/920; D9/432

[58] Field of Search ..... 229/109, 116.1, 229/137, 138, 920; D9/430, 432, 433

[56] References Cited

U.S. PATENT DOCUMENTS

| | | | |
|---|---|---|---|
| D. 244,993 | 7/1977 | Drysdale | D9/432 |
| 2,050,894 | 8/1936 | Paige | 229/116.1 |
| 2,067,998 | 1/1937 | Williamson | 229/116.1 |
| 2,815,164 | 12/1957 | Painter . | |
| 3,126,143 | 3/1964 | Hagan | 229/920 |
| 3,610,514 | 10/1971 | Samsung | 229/116.1 |
| 3,650,458 | 3/1972 | Rausing . | |
| 3,785,113 | 1/1974 | Mårtensson et al. . | |
| 3,788,033 | 1/1974 | Mårtensson et al. . | |
| 3,795,359 | 3/1974 | Rausing . | |
| 3,797,726 | 3/1974 | Reil . | |
| 3,884,131 | 5/1975 | Palsson . | |
| 3,900,155 | 8/1975 | Rausing et al. . | |
| 3,924,796 | 12/1975 | Rausing et al. . | |
| 3,933,297 | 1/1976 | Carlsson et al. . | |
| 3,943,682 | 3/1976 | Rausing . | |
| 3,961,742 | 6/1976 | Stark et al. . | |
| 3,985,284 | 10/1976 | Palsson . | |
| 3,999,469 | 12/1976 | Nilsson . | |
| 4,027,455 | 6/1977 | Rausing et al. . | |
| 4,054,074 | 10/1977 | Mårtensson et al. . | |
| 4,078,715 | 3/1978 | Larsson et al. . | |
| 4,088,260 | 5/1978 | Stark et al. . | |
| 4,101,051 | 7/1978 | Reil . | |
| 4,196,035 | 4/1980 | Reil . | |
| 4,232,048 | 11/1980 | Palm et al. . | |
| 4,248,351 | 2/1981 | Berg . | |
| 4,267,957 | 5/1981 | Holmström . | |
| 4,313,556 | 2/1982 | Boyle et al. | 229/116.1 |
| 4,714,164 | 12/1987 | Bachner . | |
| 5,000,375 | 3/1991 | Farber et al. . | |
| 5,232,146 | 8/1993 | Antonacci . | |

FOREIGN PATENT DOCUMENTS

| | | | |
|---|---|---|---|
| 49592 | 4/1982 | Australia . | |
| 276873 | 8/1988 | European Pat. Off. | 229/138 |

*Primary Examiner*—Gary E. Elkins
*Attorney, Agent, or Firm*—Burns, Doane, Swecker & Mathis, L.L.P.

[57] ABSTRACT

Substantially parallelepipedic packaging and gable-top containers for liquid contents, for example milk, are manufactured by folding and sealing of laminated packaging material and include two substantially planar end portions, as well as four vertical wall panels. The volume of the packaging container may be increased in relation to the area of the packaging material employed in that the vertical wall panels, the primary wall panels, are supplemented with secondary wall panels which are defined by straight, vertical fold lines which, at the upper and lower ends of the panels, respectively, merge into pairwise converging diagonal fold lines which intersect at a point. In a blank for the packaging containers, the wall panels are defined throughout the greater part of their length, by straight, parallel, vertical fold lines.

36 Claims, 3 Drawing Sheets

FIG. 7
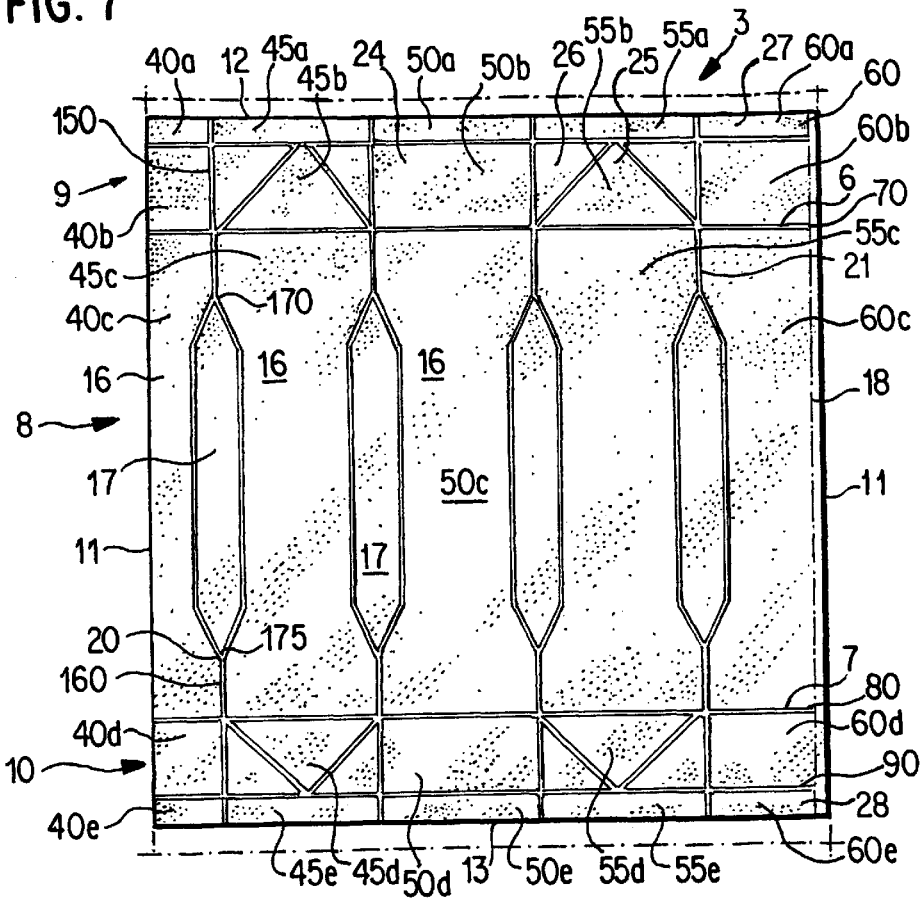
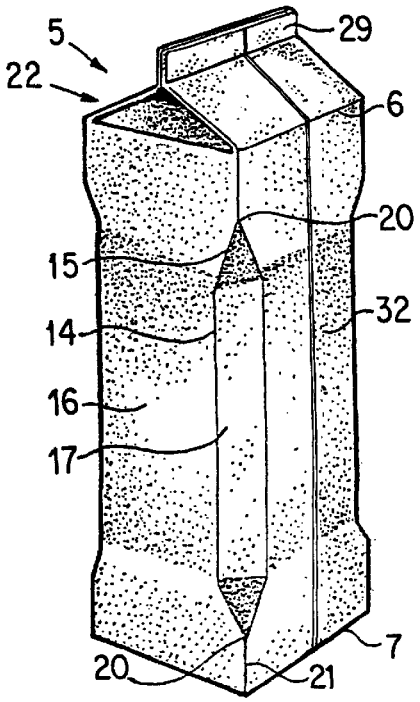
FIG. 8
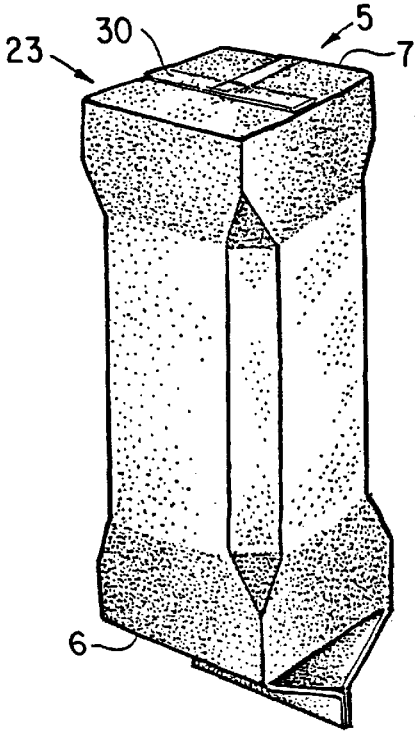
FIG. 9

PACKAGING CONTAINER AND A BLANK FOR PRODUCING THE SAME

CROSS-REFERENCE TO RELATED APPLICATION

This application is a continuation-in-part of U.S. application Ser. No. 08/620,698 filed Mar. 21, 1996, now U.S. Pat. No. 5,738,272.

FIELD OF THE INVENTION

The present invention relates to packaging containers formed from laminated packaging material that are provided with fold lines or crease lines in order to facilitate conversion of the packaging material into individual filled and sealed packaging containers, and to blanks or packaging material from which the containers are formed.

BACKGROUND OF THE INVENTION

Consumer packages of the single-use disposable type for beverages or other consumer products are normally produced from laminated packaging material comprising layers of, for example, paper, thermoplastic and aluminum foil. The material is flexible but relatively rigid and is provided with fold or crease lines in order to facilitate reforming or conversion of the material into individual, filled and sealed packaging containers. The necessary, liquid-tight seals are normally realized by heat-sealing, in which event the thermoplastic layers of the packaging material are employed as adhesive or bonding agent. Prior art packaging containers of this type are normally either parallelepipedic (Tetra Brik®), or of the so-called gable-top type (Tetra Rex®), and are described in EP 19324 and EP 356831, respectively, to which publications reference is now made. Both the parallelepipedic packaging containers and packaging containers of the gable-top type most generally include four vertical wall panels or side walls with top and bottom panels. Typically, the parallelepipedic containers have two opposite side walls of narrow width and the remaining two side walls are substantially wider than the other side walls. Gable-top containers typically have side walls of substantially equal width.

Parallelepipedic or gable-top packaging containers with four mutually rectangular side wall panels have long been predominant in this type of packaging container which is normally employed for the packing of, for instance, milk, juice or other liquid consumer products. One important reason for this situation is that symmetric packaging containers displaying a substantially rectangular cross-sectional configuration are well-suited for handling, not only by the consumer, but also in robotics or machine handling in connection with production and various types of carton grouping or marshalling. The consumer packages are, for example, normally placed in groups of 18 (3×6) packages in trays or cartons which are then provided with lids or are shrink-film wrapped. By adapting the tray size to the size of the marshalled group of packages, a stable and handlable unit will be obtained, since, as a result of the shape of the package, the side wall panels of the individual packaging containers abut closely against one another and afford mutual support.

Thus, while the currently predominant packing configurations enjoy major practical advantages, they have not attained optimum design in view of packaging material consumption in relation to packed volume. In strictly geometric terms, the ideal packaging container configuration from this point of view is the sphere, but for practical reasons, a ball-shaped packaging container is, of course, less suitable. Attempts to minimize material consumption per packed volume by giving an initially substantially parallelepipedic package more or less outwardly bulging wall panels have, however, been made by placing double-tapering secondary wall panels between the original side wall panels (the primary wall panels), as disclosed in EP Patent 277,673. Granted, this procedure reduces the material consumption somewhat, but the packaging container will, with its outwardly bent walls, have a functionally inferior configuration which causes difficulties in handling and in the placing of the package in grouped transport and storage cartons.

Further, in the above-mentioned prior art packaging containers of parallelepipedic configuration, the flat-laid corner flaps which occur in connection with folding and forming must be folded down to and secured at the outside of the packaging container so that they are not inadvertently folded out during handling of the packaging container. A dependable securement of the corner flaps requires that they can be folded down and fixed against a substantially planar surface of at least the same size as the area of the flat-laid corner flap. Arched, curved or angled surfaces make it difficult to reliably seal the corner flaps in a planar position. Projecting or poorly sealed corner flaps readily come loose when the packaging container is being handled and offer particular problems in the packing of the packaging containers into crate or tray shaped group transport containers, since, in such instance, it must be possible for the packages to be pushed or slid down into a relatively narrow and tight space.

Similarly, gable top containers are typically designed to have a volume that is specified by the packager and selected from standard volumes that have been deemed accepted by the consumer market for the product (i.e., pint, quart, half-gallon, gallon, one-half liter, liter, etc.). The surface area of the carton, and particularly the area of the four side walls, the majority of the surface area, is generally fixed for a given container volume. A reduction in the surface area of the gable top container would reduce the amount of material used to form the containers, thereby reducing the cost of the containers, provided the container still has the required volume.

It will be apparent from the foregoing discussion that the need to increase the theoretical volume of contents of the packaging container in relation to the area of consumed packaging material in part runs contrary to two other necessitating factors, i.e. the need of maintaining, substantially planar wall panels for imparting stability and good handling properties to the container, and secondly the need to provide for dependable anchorage possibilities for the corner flaps of parallelepipedic containers. Similarly, the traditional formation of the gable top container is based on having four flat side walls.

SUMMARY OF THE INVENTION

One object of the present invention is, thus, to impart, without expensive technical intervention and retroconstruction, to prior art parallelepipedic or gable-top shaped packaging containers, a greater volume in relation to consumed material area, at the same time as the packaging containers, while obtaining a different profile in terms of appearance, retain their suitable shape from the point of view of handling and packing, with predominantly planar wall panels and good or even improved handling strength.

A further object of the present invention is to provide a packaging container of the above-outlined, parallelepipedic basic type in which the wall panels display substantially planar areas for securing the flat-laid corner flaps.

Still a further object of the present invention is to provide a packaging container of the above-mentioned, fundamentally parallelepipedic type, in which the corner flaps are, in the flat-laid state connected to the outside of the packaging container, recessed in such a manner that they do not extend outside the outer contour of the packaging container, and, as a result, run no risk of being loosened or released in the handling of the packaging container.

Still a further object of the present invention is to provide a blank for producing the above-outlined packaging container.

The above and other objects have been attained according to the present invention by a packaging container of the type disclosed by way of introduction that has secondary wall panels at the corners of the side walls that are defined by two substantially straight vertical fold lines which, at the upper and lower ends of the panels, respectively, merge into pairwise converging diagonal fold lines which meet at one point. This achieves reduction in the amount of packaging material required to produce a container of the same volume.

A blank of the type described by way of introduction has, in accordance with this invention, wall panels that are, throughout the greater part of their length, defined by straight, parallel vertical fold lines. The carton blank comprises a generally rectangular body having an upper section, a mid section, and a lower section, each of the sections being separated from each other by one or more generally horizontal score lines. The upper section of the rectangular body comprises a plurality of score lines for defining a folded top section of the resulting carton while the lower section of the rectangular body comprises a plurality of scope lines for defining a folded bottom section of the resulting carton. The mid section of the rectangular body comprises a plurality of score lines for defining beveled side walls at the comers of the resulting carton. The score line at each corner include diagonal score lines intersecting at a point. The diagonal score lines are provided adjacent the upper section and adjacent the lower section.

BRIEF DESCRIPTION OF THE DRAWINGS

Preferred embodiments of the packaging container and the blank according to the present invention are described herein with particular reference to the accompanying drawings, in which:

FIG. 7 shows a blank for a second embodiment of a packaging container according to the present invention;

FIG. 8 is a perspective view of a second embodiment of the packaging container according to the present invention, seen obliquely from above; and FIG. 9 is a perspective view of the packaging container according to FIG. 8, seen obliquely from beneath.

DESCRIPTION OF PREFERRED EMBODIMENTS

Figure 1:
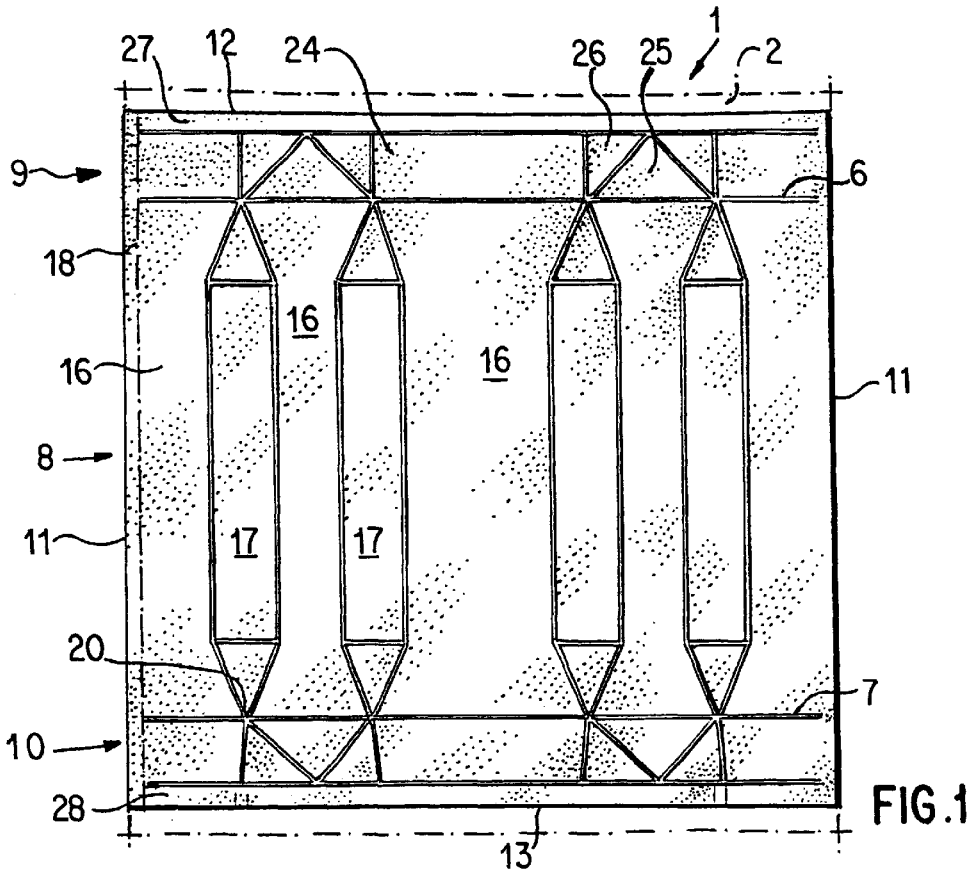
FIG. 1 shows a blank for a first embodiment of a packaging container according to the present invention.

Like previously known packaging containers and blanks of similar type, the packaging container and packaging container blanks according to the present invention are normally employed for the packaging of liquid foods such as, for instance, milk and juice. In such instance, use is normally made of packaging materials which comprise a plurality of mutually laminated layers of, for example, paper, plastic and aluminum foil. A typical packaging laminate thus comprises a central, relatively thick layer of fiber material or paper which, on either side, is coated with layers of thermoplastic material, for example polyethylene. In order to improve the gas-barrier properties of the packaging material, it may also include an additional layer of barrier type, e.g. of aluminum foil, which in turn is covered by a liquid-tight coating of thermoplastic, for example polyethylene. This layer subsequently forms the inner surface of the packaging container which comes into contact with the container's contents. Both the outside of the packaging laminate and its inside are thus covered by thermoplastic material, which is employed so as to make possible heat sealing of the packaging laminate during reforming of the blank into a finished, filled packaging container. The heat sealing technique employed in this instance is well-known in the art, as are both the material and the methods and apparatus employed for producing conventional, similar types of packaging containers. For further information in this regard, reference may be made to, for instance, EP 19324, which is hereby cited by way of reference.

FIG. 7 illustrates a further embodiment of a blank that may be used to form a carton in accordance with the teachings of the present invention. The carton blank 3 has a plurality of panels that are effectively separated from one another by a plurality of score lines. As viewed along the horizontal direction, the plurality of panels include first vertical panel sections 40*a–e*, second vertical panels 45*a–e*, third vertical panels 50*a–e*, fourth vertical panels 55*a–e*, and fifth vertical panels 60*a–e*. The first panel sections 40*a–e* having a smaller width than the fifth panel sections 60*a–e*, while both the first and fifth panel sections 40*a–e*, 60*a–e* are less wide than the second, third and fourth panel sections 45*a–e*, 50*a–e*, and 55*a–e*. As viewed along the vertical direction, the plurality of panels include top fin panels 40*a*, 45*a*, 50*a*, 55*a*, and 60*a*, top flap 40*b*, 45*b*, 50*b*, 55*b*, and 60*b*, side panels 40*c*, 45*c*, 50*c*, 55*c*, and 60*c*, bottom flaps 40*d*, 45*d*, 50*d*, 55*d*, and 60*d*, and bottom fin panels 40*e*, 45*e*, 50*e*, 55*e*, and 60*e*.

As should be apparent from the descriptions of the various embodiments of the blanks of the present invention, the top fin panels 40*a*–60*a* and the top flaps 40*b*–60*b* fold to form the gable top of the carton. Similarly, the bottom flaps 40*d*–60*d* and the bottom fin panels 40*e*–60*e* form the bottom of the carton and may take on any number of the configurations described herein.

In accordance with the embodiment illustrated in FIG. 7, the top of the blank and the bottom of the blank are defined by straight cuts. As a result, the top fin panels 40*a*–60*a* each have a straight upper portion. A plurality of horizontally disposed score lines divide the top fin panels 40*a*–60*a* from the top flaps 40*b*–60*b*. The score lines dividing the top fin panels 40*a*–60*a* from the top flaps 40*b*–60*b* lie generally along a first horizontal axis 60. The top flaps 45*b* and 55*b* each include a pair of diagonal score lines that converge at a respective apex. Each respective apex, for example, may converge at the horizontal score line dividing the respective top fin panel 45*a* and 55*a* and top flap 45*b* and 55*b*.

A second plurality of horizontally disposed score lines divide the top flaps 40*b*–60*b* from the side panels 40*c*–60*c*. The score lines dividing the top flaps 40*b*–60*b* from the side panels 40*c*–60*c* lie generally along a second horizontal axis 70, which corresponds generally to fold line 6, discussed in greater detail below.

A third plurality of horizontally disposed score lines divide the side panels 40*c*–60*c* from the bottom flaps 40*d*–60*d*. The score lines dividing the side panels 40*c*–60*c* from the bottom flaps 40*d*–60*d* lie generally along a third horizontal axis 80, which corresponds generally to fold line 7, discussed in greater detail below.

A fourth plurality of horizontally disposed score lines divide the bottom flaps 40*d*–60*d* from the bottom fin panels 40*e*–60*e*. The score lines dividing the bottom flaps 40*d*–60*d* from the bottom fin panels 40*e*–60*e* lie generally along a fourth horizontal axis 90. To facilitate formation of the bottom structure, the second and fourth bottom flaps 45*d* and 55*d* each include a pair of diagonal score lines that each converge at a respective apes. Each respective apex, for example, may converge at the horizontal score line dividing the respective bottom fin panel 45*e* and 55*e* from the bottom flap 45*d* and 55*d*.

The vertical sections 40–60 are each divided from one another by a unique configuration of score lines. In the embodiment of FIG. 7, a vertical score line 150 divides the first and second top fin panels 40*a*, 45*a* and the first and second top flaps 40*b*, 45*b*. The vertical score line 150 further extends to partially divide the first and second side panels 40*c*, 45*c* from each other. A further vertical score line 160 divides the first and second bottom flaps 40*d*, 45*d*, and the first and second bottom fin panels 40*e*, 45*e*. The further vertical score line 160 also partially divides the first and second side panels 40*c* and 45*c*. The vertical score line 150 and the further vertical score line 160 are collinear along a vertical axis. The endpoints 170, 175 of the vertical score lines 150 and 160, respectively, are disposed a distance apart from one another. A similar score line structure divides the second and third vertical sections 45 and 50, the third and fourth vertical sections 50 and 55, and the fourth and fifth vertical sections 55 and 60.

Such a packaging container blank 1 is shown in FIG. 1, as part of a packaging material web 2. The packaging container blank 1 is intended for conversion into a packaging container 4 of the type which is illustrated in FIGS. 2–6. The packaging container 4 is produced by folding and heat sealing of initially planar packaging material. The blank 1 is supplied in a continuous web to be formed, filled and sealed and separated from the web 2 as described generally in U.S. Pat. No. 4,580,392, which is cited by way of reference. In order to facilitate this fold-formation operation, the packaging container blanks 1 are provided with a pattern of fold lines.

To facilitate fold-formation into the desired packaging container shape, each packaging container blank 1 is provided with a pattern of fold lines which normally may consist of crease lines or score lines, i.e. linear depressions into the material, but may also consist of perforations or other types of known lines of weakening in the material. For short distances, the fold lines may also be spontaneous. These are folds which occur as an immediate result of adjacent parts being folded along, for example, prefabricated crease lines. Each one of the packaging container blanks 1 is divided, by means of two horizontal fold lines 6, 7, into a substantially central wall area 8, an upper end area 9 and a lower end area 10. The horizontal fold lines 6 and 7 are substantially straight and extend in parallel throughout the whole or greater part of the width of the packaging container blank 1, i.e. in principle transversely between the longitudinal edges 11 of the packaging material web 2 (FIG. 1). The wall area 8 located between the two horizontal fold lines 6 and 7 is divided, with the aid of vertical fold lines 14, and diagonal fold lines 15, into a number of alternating primary wall panels 16 and secondary wall panels 17, more precisely four of each type. In the flat-laid, unsealed packaging container blank, one of the primary wall panels 16 is divided into two parts which are not connected to one another until during the reforming of the packaging container blanks 1 into finished packaging containers, in which instance both longitudinal edges 11 of the packaging material web are sealed in liquid-tight fashion to one another with the aid of a longitudinal sealing panel 18. In the embodiment of FIGS. 1–6, the container produced from the blank 1 has a rectangular top and bottom with opposite narrow sides and opposite wider sides.

In the first embodiment of the packaging container 4 and blank 1, secondary fold lines 19 (FIG. 4) extend pairwise transversely over each secondary wall panel 17 and divide it into an elongate rectangular portion with triangular portions connected to the short sides. Each secondary wall panel 17 is thus defined by two mutually parallel vertical fold lines 14 which extend over the greater part of the height of the packaging container blank 1. Preferably, the vertical fold lines 14 have a length that is greater than one-half of the distance between the fold lines 6 and 7. This proportion provides the desired shape of the container. The vertical fold lines 14 intersect the secondary fold lines 19 and the diagonal fold lines 15, which converge pairwise and meet at a point 20 which, in the embodiment according to FIGS. 1–6, is located at the upper and lower horizontal fold lines 6, 7, respectively.

The upper and lower end areas 9 and 10 include a number of end wall panels which make possible folding and sealing of the upper and lower end portions 22, 23, respectively, of the packaging container. Each end area 9, 10 includes a number of substantially rectangular end panels 24, a number of substantially triangular corner panels 25 and adjacent substantially triangular refold panels 26. Each end area 9 and 10 is terminated, at the transverse incision edges 12, 13 of the packaging container blank, by means of an elongate transverse seal panel 27, 28 which extends over the entire width of the packaging container blank 1.

The reforming of the planar packaging container blank 1 into finished, filled and sealed packaging containers 4 starts with an elongate packaging material web 2, in which the packaging container blanks are formed, as in FIG. 1. The first process step is a refolding or reforming of the material web into tube form, whereafter the two longitudinal edges 11 are, utilizing the longitudinal sealing panel 18, joined together to form a liquid-tight sealing joint or seam. The thus formed material tube is then filled with the intended contents, whereafter transverse flat-pressing and sealing in the upper and lower transverse seal panels 27 and 28, respectively, divides the tube into cushion shaped, continuous semi-manufactures. In such instance, a certain forming processing of the tube may possibly take place with the intention of commencing folding in the substantially longitudinal vertical and diagonal fold lines 14, 15.

Figure 2:
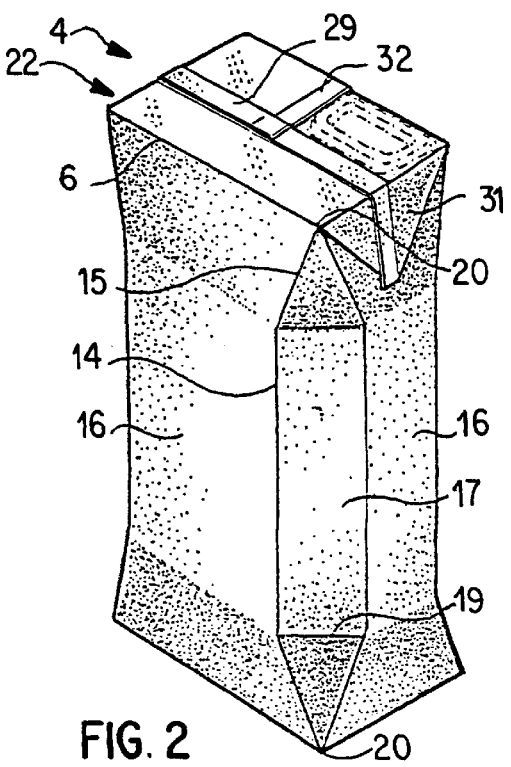
FIG. 2 is a perspective view of a first embodiment of the packaging container according to the present invention, seen obliquely from above.
Figure 3:
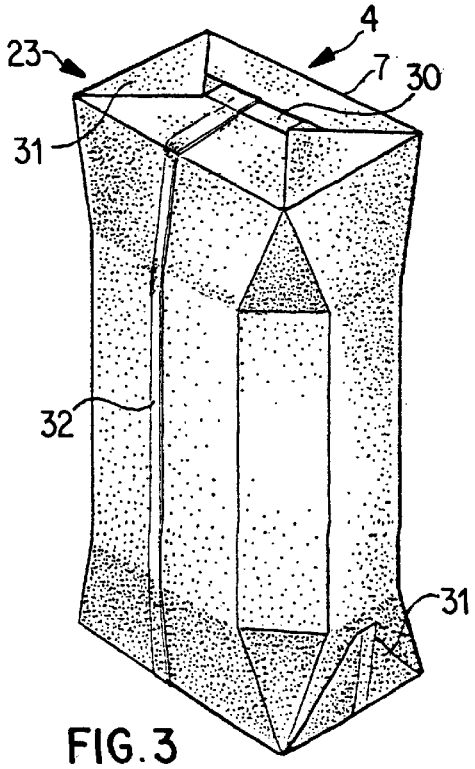
FIG. 3 is a perspective view of the packaging container of FIG. 2, seen from beneath.
Figure 4:
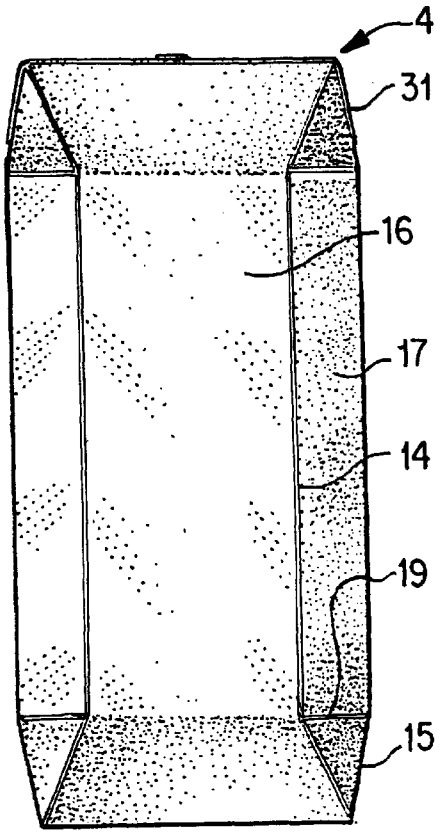
FIG. 4 is a side elevational view of the packaging container according to FIGS. 2 and 3.
Figure 6:
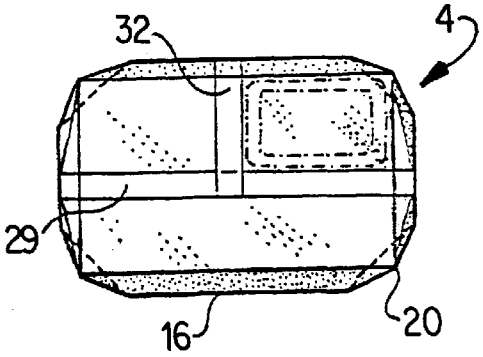
FIG. 6 is a top plan view of the packaging container according to FIGS. 2 to 5.
Figure 5:
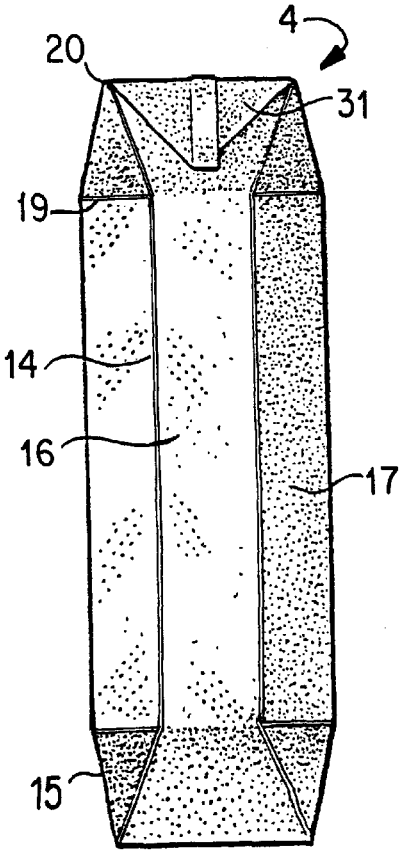
FIG. 5 is an end elevational view of the packaging container according to FIGS. 2 and 3.

The mutually continuous, cushion-shaped packaging container blanks are then separated from one another by transverse incisions in the transverse seal panels 27, 28, converted into the sealing fins 29, 30. The thus separated, fully filled packaging container blanks are then subjected to a final forming processing, with the aid of profiled flaps or plates which are caused to surround the packaging container so that, utilizing the contents housed in the package as a buffer force, they are pressed against the packaging container so that this obtains the desired final shape by final folding in the fold lines. In such instance, a certain excess material is created for reasons of pure geometry, this excess material being accumulated in the four corner flaps 31 which, in a separate, later operation, are pressed flat and also folded down and sealed against the outside of the packaging container, as shown in FIGS. 2 and 3.

FIGS. 2–6 show how a packaging container blank according to FIG. 1 has, by folding and sealing, been reformed into a finished packaging container 4. It will be apparent from these Figures how the different panels 24–28 forming each respective end area 9 and 10 are utilized for forming the substantially planar end portions 22, 23. The sealing panels 27, 28 form sealing fins 29, 30 extending over the end portions 22, 23, while the end panels 24 together form the main part of the planar surfaces of the end portions 22, 23. The triangular corner panels 25 form, together with the refold panels 26, triangular flat-pressed corner flaps 31 which are hinged along the short sides of the rectangular top and which have been folded down towards and sealed to the outside of the packaging container in a known manner. More precisely, the corner flaps 31 have, at the upper end portions 22 of the packaging container, been folded down and sealed to the shorter two of the primary wall panels 16 of the packaging container, while the corner flaps 31 at the lower end portion of the packaging container have been folded back along the short side of the rectangular bottom and sealed against the bottom of the packaging container. It will also be apparent from these Figures how the longitudinal sealing panel 18 forms a sealing seam 32 which extends vertically over the packaging container and divides the one primary wall panel 16 into two parts, as well as extending up to the two transverse sealing fins 29, 30 of the packaging container.

In the second embodiment of the packaging container according to the present invention (FIGS. 7–9), the container produced from the blank 3 has a square top and bottom sides with substantially equal length. The packaging container blank 3 has two horizontal fold lines 6, 7 which divide the blank into a central wall area 8, an upper end area 9 and a lower end area 10. The blank 3 has longitudinal edges 11 and transversely extending edges 12 and 13. The central wall area 8 is divided by vertical fold lines 14 and diagonal fold lines 15 into four primary wall panels 16 and four secondary wall panels 17. The arrangement of the fold lines in this second embodiment (FIGS. 7–9) is substantially the same as the arrangement of the fold lines in the first embodiment (FIGS. 1–6), except that the secondary fold lines 19 are omitted in the second embodiment because the secondary wall panels are more narrow than those of the first embodiment and therefore are easier to shape. Another difference is that the points 20 (FIG. 8) are spaced from the horizontal fold lines 6, 7 and the diagonal fold lines 15 intersect at the point 20. Vertical corner fold lines 21 extend between the point 20 and the respective horizontal fold lines at each corner.

The illustrated second embodiment of the packaging container (FIGS. 7–9) displays a gable-top shaped upper end portion 22. In this embodiment, the blanks 3 are normally separated from the material web before being formed into containers, and reforming takes place individually for each blank. As in the first-mentioned type of packaging container blank, the forming operation is commenced in that the packaging container blank 3 is reformed into tube form by both of its longitudinal edges 11 being sealed to one another in a sealing region 18. As shown in FIG. 9, the bottom formation thereafter takes place in that the different panels which form the lower end area 10 are refolded, utilizing the illustrated folding lines, into a planar, liquid-tight sealed end portion 23 or bottom. As in the embodiment of FIGS. 1–6, the excess material which occurs here forms corner flaps which, however, in this embodiment are folded in under both end panels 24 and, as a result, are invisible in FIG. 9. The lower transverse seal panel 28 is utilized for forming a sealing fin 30 which is caused to abut against the bottom of the packaging container. This forming procedure converts the packaging container blank 3 into an upwardly open packaging container. This type of container is then filled with the intended contents before the top is formed and closed.

After filling the gable-top shaped upper end portion 22 of the packaging container is closed and sealed. This is effected in a manner corresponding to that which applies to the bottom forming process, i.e. both end panels 24 are collapsed towards one another during simultaneous inward folding of the corner panels 25 and refold panels 26 beneath the end panels 24. The upper transverse sealing panel 27 is then employed for liquid-tight sealing of the panels 24, 25, 26 to one another so that an upwardly projecting sealing fin 29 is created. The packaging container is thereby fully finished, and no further forming operation is normally undertaken, since, in this packaging container, the secondary wall panels 17 are of considerably smaller width and automatically obtain the desired form and configuration in connection with the reforming of the planar packaging container blank 3 into the tube form. If, however, it proves necessary, an outer forming processing work may also here be carried out with the aid of suitably shaped flaps or other tools, and of course secondary fold lines may also occur in this embodiment in order to facilitate the forming operation.

The packaging container body of the embodiments of both FIGS. 1 and 7 is, by means of the vertical fold lines 14 and diagonal fold lines 15, divided into four primary wall panels 16 and four secondary wall panels 17, as a result of which the packaging container is given, throughout the greater part of its height, an octagonal configuration whose cross-sectional area is greater than the cross-sectional area at the upper and lower end portions 22, 23 of the two embodiments of the packaging container, respectively. This difference is particularly manifest from FIG. 6. The vertical, mutually parallel fold lines 14 ensure that both the primary wall panels 16 and the secondary wall panels 17 have the same width over the greater part of their length, which entails that the central portion of the wall panels consists of mutually parallel, planar wall portions. In the embodiment of FIGS. 1–6, the secondary wall panels 17 have a width which is substantially the same as the width of the primary wall panels 16 on the narrow side walls of the container 4. This gives maximum volume and, imparts to the packaging container suitable proportions which facilitate grasping of the packaging container when it is opened and poured from.

With the aid of the diagonal fold lines 15 and the isosceles triangular tapering end portions of the secondary wall panels 17, the substantially octagonal central portion of the packaging container progressively merges into the rectangular cross-sectional configuration which corresponds to the configuration of the end portions 22, 23. In this instance, the triangular end portions of the secondary wall panels 17 will incline somewhat outward in relation to the vertically extending rectangular portion of the secondary wall panels 17, this folding is facilitated by secondary fold lines 19 (where applicable). Correspondingly, an upper and lower portion, respectively, of the primary wall panels 16 will incline somewhat inwardly from the outer contour of the packaging container determined by the central portion of the above-mentioned wall panels. In order to facilitate this, it is naturally also conceivable to provide the primary wall panels with transverse fold lines corresponding to the secondary fold lines 19, which, in two of the upper portions of the narrow primary wall panels 16 (FIG. 2), is employed for securing the flat-laid corner flaps 31, whose height (vertical length) substantially corresponds to, or is slightly less than the height of the triangular portions of the secondary wall panels 17. In such instance, the corner flaps 31 will, when they are folded down towards the outside of the packaging container and sealed to the upper portions of the above-mentioned primary wall panels 16, not increase the width of the packaging container, but will instead be located inside an imaginary vertical extension of the central portion of the above-mentioned primary wall panel 16. Hereby, the corner flaps 31 will be protected on transport and handling, of the packaging containers, e.g. in connection with placing of a plurality of packaging containers in tight formation in a group transport carton or package of known type.

The fact that the wall panels largely consist of mutually parallel, planar wall portions is made advantageous use of in the placing of the packaging container in so-called group transport packages, i.e. trays of paper or plastic with relatively low wall sections. The reason for this is that, in the packaging container according to the present invention, on being stacked in such a tray, the planar, parallel wall portions 16 of the packaging containers will come into abutment with one another throughout the greater part of the height of the packaging container, which affords mutual support to the group transport package and reduces the risk that the individual packaging containers topple over or are displaced in relation to one another. Since the planar wall portions extend a relatively great distance down towards the lower ends of the packaging containers, tray-shaped group transport containers with relatively low wall sections may be used. In principle, it is sufficient that the wall portions extend up slightly above the lower end of the planar wall portions of the containers.

In prior art types of packaging containers in which corresponding wall portions display a uniform curvature distributed over the entire height of the packaging wall, this supporting and stabilizing function is lost and, as a result, the group transport container must be provided with walls which are of a considerably greater height and preferably extend somewhat above half of the height of the packaging containers they carry. Even using this design and construction, the stability of the filled tray is nevertheless reduced since the absence of planar mutually abutting wall portions results in the packaging containers being able to be displaced or slid so that they become tilted in the group transport container in the event of jolts or jerks when being transported or handled, etc. Finally, the packaging container according to the present invention may also be provided with an opening arrangement 33 of any optional known type.

As is apparent from FIGS. 7–9, the secondary wall panels 17, including the diagonal fold lines 15 defining the end portions of the secondary wall panels 17 do not extend up to the horizontal fold lines 6 and 7, but intersect at the point 20 which is spaced from the two respective horizontal fold lines 6 and 7. A vertically extending corner fold line 21 interconnects the point 20 and the corner of the top and bottom respectively. Hereby, the secondary wall panels 17 will, in this type of packaging container, be slightly shorter than in the first-mentioned embodiment in the foregoing, and since the secondary wall panels 17 are also of lesser width, the packaging container body will be of a different appearance. The central mid-portion with substantially planar, parallel wall parts is also to be found in this embodiment, but the inclining wall portions which connect the central portion of the packaging container body (octagonal in cross-section) with the rectangular end portions 22, 23 will be slightly curved or concave. This type of packaging container also makes slight gains in a comparison with conventional packaging containers provided with four planar side walls in terms of volume compared with the area of the packaging material utilized. Furthermore, the packaging container will be of a different profile, which makes it possible to distinguish it more easily and employ it as a vehicle for identifying a specific product type.

By imparting to the blank and the packaging container a configurational appearance according to the present invention, it will be possible using prior art production techniques to reform or convert a planar blank provided with a pattern of folding lines into a packaging container which, as compared with previously known packaging containers of similar type, accommodates a greater volume of contents in relation to the surface area of consumed packaging material. The packaging container will have an octagonal cross-section at its central portion with the walls being substantially vertical and planar. As a result, the packaging container will have a well-defined contour, which makes for the simple handling and compact placing of the packaging containers in the group transport containers or cartons.

As a result of the design and formation according to the present invention of both the packaging container blanks and the packaging containers proper, there will thus be achieved a number of advantages. The improved economy, which is inherent in the advantageous relationship between packed volume and consumed material area in practice provides significant savings in the quantity of material used to form a package of a given volume. According to the invention, packages having a volume of, e.g., 1000 ml have been manufactured with 8% less material than was previously required to make a package of the same volume. It is also vital to note that the packaging container will have a different, distinguishing appearance at the same time as becoming easier to grasp and easier to use for the consumer. As a result of the design and formation with exclusively straight (but mutually angled) vertical and diagonal fold lines, there will be realized relatively large, planar and parallel wall surfaces, which retain the superior stacking capability on packing of the packaging containers into group transport packages, at the same time as handling of the packaging containers themselves is facilitated. Since the packaging containers may finally be manufactured employing fundamentally the same methods and equipment as in previously known, similar types of packaging containers, a transition to this type of packaging container may be put into effect without extensive and expensive redesign and reconstruction or retooling of the machinery employed.

The present invention may be further modified without departing from the spirit and scope of the appended claims.

What is claimed is:

1. A packaging container for liquid products comprising a plurality of side wall panels and a top portion and a bottom portion, the side wall panels extending between the top portion and the bottom portion and including secondary wall panels, each secondary side wall panel being defined by a pair of vertical fold lines having their ends spaced from the respective top portion and bottom portion and by a pair of diagonal fold lines extending from the ends of the vertical fold lines and converging toward the top portion and the bottom portion respectively, said top portion and bottoms portion forming liquid-tight seals including at least one of said top and bottom portions having a transverse sealing fin.

2. The packaging container according to claim 1, wherein said diagonal fold lines intersect at a point that is located at the top portion and the bottom portion of the container.

3. The packaging container according to claim 1, wherein said diagonal fold lines intersect at a point that is spaced from the top portion and the bottom portion of the container.

4. The packaging container according to claim 1, wherein the vertical fold lines are substantially parallel.

5. The packaging container according to claim 4, wherein the top portion and the bottom portion are rectangular with a pair of narrow side wall panels and a pair of wide side wall panels, the width of the secondary wall panels is substantially the same width as the narrow primary wall panels.

6. The packaging container according to claim 5, wherein the top portion includes downwardly folded corner flaps at each end of the rectangular top portion and overlapping a narrow primary side wall panel.

7. The packaging container according to claim 4, wherein each secondary wall panel includes an elongate, rectangular portion formed between the respective pairs of vertical fold lines, with triangular portions connecting to their short sides.

8. The packaging container according to claim 7, wherein the triangular portions have substantially the same height as the downwardly folded corner flaps.

9. The packaging container according to claim 4 including fold lines extending transversely between the vertical fold lines of the secondary wall panels.

10. The packaging container according to claim 4, wherein the top portion and bottom portion are square, and the top portion is arranged in the shape of a gable top.

11. The packaging container according to claim 8, wherein the rectangular portion of the secondary side wall panels is substantially planar.

12. The packaging container according to claim 1, wherein the top portion includes downwardly folded corner flaps at two opposing sides of the top portion, each said corner flap overlapping one of said side wall panels.

13. The packaging container according to claim 1, wherein the top portion includes downwardly folded corner flaps, each secondary wall panel includes a quadrilateral portion formed between the respective pairs of vertical fold lines and triangular portions formed by the pair of diagonal fold lines, the triangular portions having substantially the same height as the downwardly folded corner flaps.

14. A blank for packaging containers for liquids, said blank comprising a packaging laminate having upper and lower horizontal fold lines corresponding to the top and bottom of the container and having primary side wall panels, and having a plurality of secondary side wall panels, the secondary side wall panels being defined by pairs of parallel vertical fold lines having their ends spaced from the upper and lower horizontal fold lines, and the secondary side wall panels being interposed between the primary side wall panels, said blank being adapted to form a substantially liquid-tight container including a transverse sealing fin.

15. The blank according to claim 14, wherein the secondary wall panels include triangular end portions.

16. The blank according to claim 15, wherein the triangular end portions are defined by diagonal fold lines intersecting at a point, said point being spaced from the horizontal fold lines.

17. The blank according to claim 15, wherein the triangular end portions are defined by diagonal fold lines intersecting at a point, said point being at the upper and lower horizontal fold lines.

18. The blank according to claim 15, wherein each secondary wall panel is divided into a central, substantially rectangular portion and, in the triangular end portions, by means of transversely extending fold lines interconnecting the vertical fold lines of the secondary side wall panels.

19. The blank according to claim 14, wherein the mutual distance between four of the adjacent, parallel vertical fold lines is substantially equal.

20. The blank according to claim 14, wherein the distance between the secondary side wall panels is substantially equal.

21. The blank according to claim 14, wherein the length of said parallel vertical fold lines amounts to more than 0.5 times the distance between the upper and lower horizontal fold lines.

22. The blank according to claim 14, wherein the fold lines are formed by creases in the packaging laminate.

23. The blank according to claim 15, further comprising corner flap fold lines extending from at least the upper horizontal fold line corresponding to corner flaps on the top of the container, said corner flap fold lines defining a corner flap height substantially equal to a height of the triangular end portions.

24. A carton comprising:

a gabled top section;

a bottom section;

four sidewalls extending between the gabled top section and the bottom section, adjacent ones of said sidewalls being joined at corner sections, each of the corner sections being defined by a first score line extending partially down from the gabled top section and a second score line extending partially upward from the bottom section, endpoints of the first and second score lines being spaced from each other.

25. A carton as claimed in claim 24 and further comprising a plurality of further score lines between the first and second score lines of the corner sections, the plurality of further score lines being offset from the corner sections.

26. A carton as claimed in claim 25 wherein the plurality of score lines define an elongated hexagonal structure.

27. A carton as claimed in claim 24 wherein the carton is side sealed along a single sidewall.

28. A blank as claimed in claim 24 wherein the blank comprises first, second, third, fourth, and fifth vertical sections.

29. A blank for forming a gable top carton comprising:

a generally rectangular body having an upper section, a mid section, and a lower section, each of the sections being separated from each other by one or more generally horizontal score lines;

the upper section of the rectangular body comprising a plurality of score lines for defining a gabled top of the resulting carton;

the lower section of the rectangular body comprising a plurality of score lines for defining a folded bottom section of the resulting carton;

the mid section of the rectangular body comprising a plurality of score lines for defining four sidewalls of the resulting carton, adjacent sidewalls being separated from one another by a first score line partially extending from the upper section and a second score line partially extending from the lower section, endpoints of the first and second score lines being separated from one another.

30. A blank as claimed in claim 29 wherein the first and second score lines are generally collinear and wherein the blank further comprises a plurality of further score lines between the first and second score lines of the corner sections, the plurality of further score lines being offset from the first and second score lines.

31. A blank as claimed in claim 30 wherein the plurality of score lines define an elongated hexagonal structure.

32. A blank for forming a gable top carton comprising:

a generally rectangular body having an upper section, a mid section, and a lower section, each of the sections being separated from each other by one or more generally horizontal score lines;

the upper section of the rectangular body comprising a plurality of score lines for defining a gabled top of the resulting carton;

the lower section of the rectangular body comprising a plurality of score lines for defining a folded bottom section of the resulting carton;

the mid section of the rectangular body comprising a plurality of mid section score lines for defining four sidewalls of the resulting carton, the plurality of mid section score lines comprising a score line configuration extending between the upper and lower sections and defining corners of adjacent sidewalls of the resulting carton, the score line configuration comprising generally vertical score lines that are offset from the corners of the carton.

33. A blank for forming a gable top carton comprising:

first, second, third, fourth, and fifth top fin panels;

first, second, third, fourth, and fifth top flaps, the second and fourth top flaps each having a pair of diagonal score lines joining at an apex;

first, second, third, fourth, and fifth side panels;

first, second, third, fourth, and fifth bottom flaps, the second and fourth bottom flaps each having a pair of diagonal score lines joining at an apex;

a first plurality of horizontally disposed score lines dividing the top fin panels from the respective top flaps;

a second plurality of horizontally disposed score lines dividing the top flaps from the respective side panels;

a third plurality of horizontally disposed score lines dividing the side panels from the respective bottom flaps;

a first vertical score line dividing the first and second top fin panels, the first and second top flaps, and partially dividing the first and second side panels;

a second vertical score line dividing the second and third top fin panels, the second and third top flaps, and partially dividing the second and third side panels;

a third vertical score line dividing the third and fourth top fin panels, the third and fourth top flaps, and partially dividing the third and fourth side panels;

a fourth vertical score line dividing the fourth and fifth top fin panels, the fourth and fifth top flaps, and partially dividing the fourth and fifth side panels;

a fifth vertical score line dividing the first and second bottom flaps, and partially dividing the first and second side panels, endpoints of the first and fifth vertical score lines being disposed a distance from one another;

a sixth vertical score line dividing the second and third bottom flaps, and partially dividing the second and third side panels, endpoints of the second and sixth vertical score lines being disposed a distance from one another;

a seventh vertical score line dividing the third and fourth bottom flaps, and partially dividing the third and fourth side panels, endpoints of the third and seventh vertical score lines being disposed a distance from one another; and an eighth vertical score line dividing the fourth and fifth bottom flaps, and partially dividing the fourth and fifth side panels, endpoints of the fourth and eighth vertical score lines being disposed a distance from one another.

34. A blank as claimed in claim 33 wherein the first and fifth vertical score lines are collinear along a first vertical axis;

the second and sixth vertical score lines are collinear along a second vertical axis;

the third and seventh vertical score lines are collinear along a third vertical axis; and the fourth and eighth vertical score lines are collinear along a fourth vertical axis.

35. A blank as claimed in claim 34 and further comprising:

a first plurality of score lines joining the endpoints of the first and fifth vertical score lines, the first plurality of score lines being offset from the first axis;

a second plurality of score lines joining the endpoints of the second and sixth vertical score lines, the second plurality of score lines being offset from the second axis;

a third plurality of score lines joining the endpoints of the third and seventh vertical score lines, the third plurality of score lines being offset from the third axis;

a fourth plurality of score lines joining the endpoints of the fourth and eighth vertical score lines, the fourth plurality of score lines being offset from the fourth axis.

36. A blank as claimed in claim 35 wherein each of the first, second, third, and fourth plurality of score lines comprises:

a first pair of diagonal score lines extending from one of the endpoints;

a second pair of diagonal score lines extending from the other of the endpoints;

a pair of generally parallel lines joining respective arms of the first and second pair of diagonal score lines.

* * * * *